US005201633A

United States Patent [19]

Peu

[11] Patent Number: 5,201,633

[45] Date of Patent: Apr. 13, 1993

[54] VERTICAL CENTRIFUGAL HYDRAULIC PUMP ASSEMBLY

[75] Inventor: Jean C. Peu, Laval, France

[73] Assignee: Pompes Salmson, Rueil Malmaison, France

[21] Appl. No.: 690,145

[22] Filed: Apr. 23, 1991

[30] Foreign Application Priority Data

Apr. 24, 1990 [FR] France ..... 90 05194

[51] Int. Cl.[5] ..... F04D 1/08; F04D 13/14; F04D 15/00

[52] U.S. Cl. ..... 415/146; 415/151; 415/199.1; 415/214.1; 417/426; 137/567; 137/854

[58] Field of Search ..... 415/146, 148, 151, 155, 415/156, 198.1, 199.1, 199.2, 201, 214.1; 137/521, 527, 843, 852, 854, 855, 567; 417/360, 426, 427, 566

[56] References Cited

U.S. PATENT DOCUMENTS

| | | | |
|---|---|---|---|
| 2,810,345 | 10/1957 | Englesson | 417/426 |
| 3,174,434 | 3/1965 | Schieve | 415/146 |
| 3,664,759 | 5/1972 | Biheller . | |
| 3,900,276 | 8/1975 | Dilworth | 417/566 |
| 4,244,675 | 1/1981 | Bower . | |
| 4,565,214 | 1/1986 | Parman | 137/854 |
| 4,669,956 | 6/1987 | Brunel et al. | 415/199.1 |
| 4,799,864 | 1/1989 | Hockley | 137/567 |
| 4,842,480 | 6/1989 | Jensen et al. | 415/199.1 |

FOREIGN PATENT DOCUMENTS

| | | | |
|---|---|---|---|
| 0360697 | 3/1990 | France . | |
| 1066594 | 4/1967 | United Kingdom . | |
| 1383467 | 2/1975 | United Kingdom . | |
| 172102 | 2/1986 | World Int. Prop. O. | 415/199.2 |

*Primary Examiner*—Edward K. Look
*Assistant Examiner*—James A. Larson
*Attorney, Agent, or Firm*—Pennie & Edmonds

[57] ABSTRACT

A vertical centrifugal hydraulic pump assembly is provided fitted with at least one replaceable pack incorporating the centrifugal hydraulic elements of the pump, the pack being clamped between two flanged end plates and mounted vertically in a receiving bore of a pump body, the base region of the receiving bore housing a flat annular non-return valve fitted between the inner wall of the bore and the outer wall of a central inlet connector, the valve opening in the direction of delivery of the pump.

6 Claims, 4 Drawing Sheets

VERTICAL CENTRIFUGAL HYDRAULIC PUMP ASSEMBLY

BACKGROUND OF THE INVENTION

The present invention relates to a vertical centrifugal hydraulic pump assembly in which the hydraulic interstage pumping assemblies are enclosed in at least one replaceable cartridge or pack constituting a block clamped vertically between two flanged end plates for retaining the pack in the bore of a pump body.

Such vertically-arranged centrifugal pump assemblies in which, for the purposes of repair or replacement of parts, it is possible to simply remove the active hydraulic part of the pump which takes the form of a replaceable pack or cartridge of hydraulic elements consisting of rotors and of stators forming a stack housed in an exchangeable cylindrical block, are widely used. Such assemblies allow very speedy replacement (usually a matter of several minutes) after provisionally removing the electric drive motor of the pump, or simply the active hydraulic part of the pump, this being the part which most frequently suffers from operating problems and problems resulting from wear. Such speedy replacement however requires a preliminary step to be carried out, consisting in isolating the pump with respect to the inlet delivery fluid supply main, which currently is not always possible. Such isolation requires that shut-off cocks be present and the closing of these can turn out to be particularly difficult in the case of units consisting of a plurality of pumps where twin or triple pumps are employed, with a standby pump able to take the place, generally in an automatic manner, of a pump that has failed.

The present invention sets out to make it possible to isolate the replaceable pack that incorporates the hydraulic elements using a simple non-return valve which requires no modification to the design and cost of pump assemblies. The provisions of the invention are particularly advantageous in the case of multiple pumps which are mounted on a single pump housing block.

SUMMARY OF THE INVENTION

In accordance with the invention there is provided a vertical centrifugal hydraulic pump assembly comprising hydraulic interstage pumping assemblies enclosed in at least one replaceable cartridge or pack constituting a block clamped vertically between two flanged end plates with a sleeve portion engaging therewith, a pump body having a receiving bore into which said pack is secured via said flanged end plates whereby it is respectively connected at the center of said bore to a central inlet connector for said pump and at the edge of said bore to a pump delivery outlet, and a flat annular non-return or check valve unit opening in the delivery sense of said pump, said non-return valve unit being arranged at the base of said receiving bore between the internal wall of said bore and the outer wall of said central inlet connector.

The use of a non-return valve for providing automatic isolation of the hydraulic part of the pump vis-a-vis the pump delivery pressure is already known but in the present invention is carried out in a particularly compact, simple and economical manner which does not lead to any interference with the flow of the fluid being pumped nor to the operation of other components of the pump assembly, and without leading to any increase in size of such pump assemblies.

In accordance with one feature of the invention, the non-return valve unit is retained in axial position by means of a first shoulder provided at the base of said receiving bore and by means of a second shoulder provided on the outer wall of said central inlet connector by retaining means that are adapted to maintain said non-return valve member in operation against a delivery pressure of said pump after removal of said pack containing said hydraulic interstage pumping assemblies.

According to a further feature of the invention, the non-return valve unit consists of a rigid plane annular plate, incorporating at least one through hole, the outer cylindrical contour of said plate fitting substantially into said receiving bore while the periphery of one plane face thereof is supported against a first shoulder provided at the base of said receiving bore, said valve unit further comprising a plane flexible annular member applied against said annular plate at the side thereof opposing said removable pack, at the inside of said pump body, in order to close off said through hole or plurality of holes, said flexible annular member bearing, at its internal peripheral region, against a second plane annular shoulder provided on the outer wall of said central inlet connector. Generally, the plane flexible annular member consists of an elastomeric material flat ring which is maintained in application against said rigid plate by a central retaining rigid annular member fitted between said plane flexible annular member and said second shoulder, said central annular member having an outer diameter that is appreciably less than a diameter defining the center of said hole or holes.

Alternatively, the plane flexible annular member consists of a thin circular plate provided with a central hole and radial outwardly-opening slots that extend up to a continuous inner crown region provided around said central hole, whereby a series of flat valve members are defined arranged in a radial disposition each one facing at least one of said through holes.

In one embodiment, the plane annular plate is retained in abutment against said first and said second shoulders by a respective first resilient annular element or circlip housed in a groove formed in the wall of said receiving bore and by a second resilient annular element or circlip housed in a groove formed in the outer cylindrical wall of said central inlet connector.

According to a further feature which enables the non-return valve to withstand higher back pressures, the plane annular plate is kept in abutment against said first and said second shoulders by abutment of the outer peripheral region of a plane surface thereof away from the region of said through hole or holes against a first annular supporting surface provided on a terminal sleeve of said lower end plate for said removable pack engaged in said receiving bore, and by abutment of the inner peripheral region of a plane surface thereof against a second annular supporting surface provided on said central inlet connector of said lower end plate for said removable pack.

According to a further feature which enables the non-return valve to withstand even higher back pressures, the plane annular plate is maintained in abutment against said first and said second shoulders by abutment of the outer peripheral region of a plane surface thereof away from the region of said through hole or holes against a first annular supporting surface provided on a terminal sleeve of a retaining end plate, said retaining end plate being identical or substantially similar to said lower end plate for said removable pack engaged in said receiving bore, and by abutment of the inner peripheral region of a plane surface thereof against a second annular supporting surface provided on a central inlet connector of said retaining end plate, and wherein said retaining end plate includes a receiving bore for said sleeve of the lower end plate for said replaceable pack.

According to still a further feature which allows the non-return valve to withstand significant back pressures after removal of the replaceable pack and, additionally, ready removal of the non-return valve itself after a long period of service, the plane annular plate is maintained in abutment against said first and said second shoulders by abutment of the outer peripheral region of a plane surface thereof away from the region of said through hole or holes against a first annular supporting surface provided on a terminal sleeve of a retaining end plate, said retaining end plate being identical or substantially similar to said lower end plate for said removable pack engaged in said receiving bore, and by abutment of the inner peripheral region of a plane surface thereof against a second annular supporting surface provided on a central inlet connector of said retaining end plate, and wherein said retaining end plate includes a receiving bore for said sleeve of the lower end plate for said replaceable pack.

The present invention also relates to a pumping unit that incorporates at least two vertical centrifugal pumps fitted with replaceable hydraulic packs, said pumps being fitted on a common inlet and outlet housing block and being adapted to operate simultaneously and/or separately, in which each vertical pump consists of a centrifugal pump assembly as described above. According to the invention, the common housing block can incorporate an integral pump inlet changeover cock having four positions respectively corresponding to isolation of the inlet to the two pumps, connection of said two pumps to the inlet, and positions in which either one of said pumps is linked to the inlet while the other pump is isolated therefrom whereby, after isolating the inlet of one of said pumps while the other pump remains in service, the said hydraulic elements pack or the isolated pump can be dismounted while being isolated from the prevailing pumping pressure by said non-return valve.

When more than two pump assemblies according to the invention are mounted on the same housing block, the common housing block can include, for each vertical centrifugal pump, a two-position cock said two positions corresponding respectively to opening and closing of the pump inlet, said cock being adapted to be independently controlled for each pump, said pump being provided with an integral said non-return valve adapted to isolate it from the common delivery pressure.

Other objects, advantages and features of the invention will become more clear from the following description of several embodiments of the invention provided by way of non-limiting illustration and with reference to the attached drawings.

DETAILED DESCRIPTION OF PREFERRED EMBODIMENTS

Figure 1:
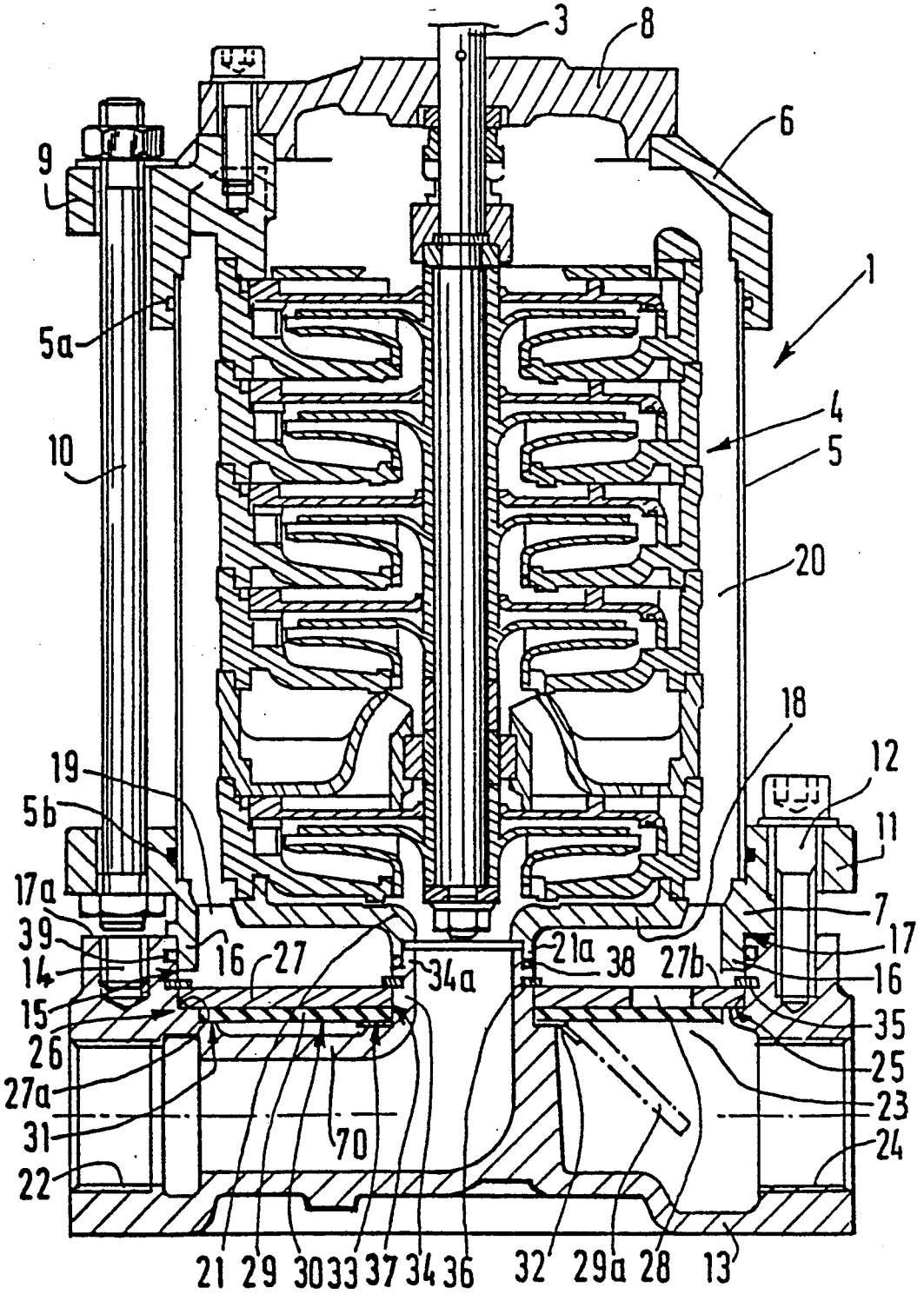
FIG. 1 is a cross-sectional view taken along the axis of a first embodiment of a centrifugal pump assembly according to the invention.
Figure 2:
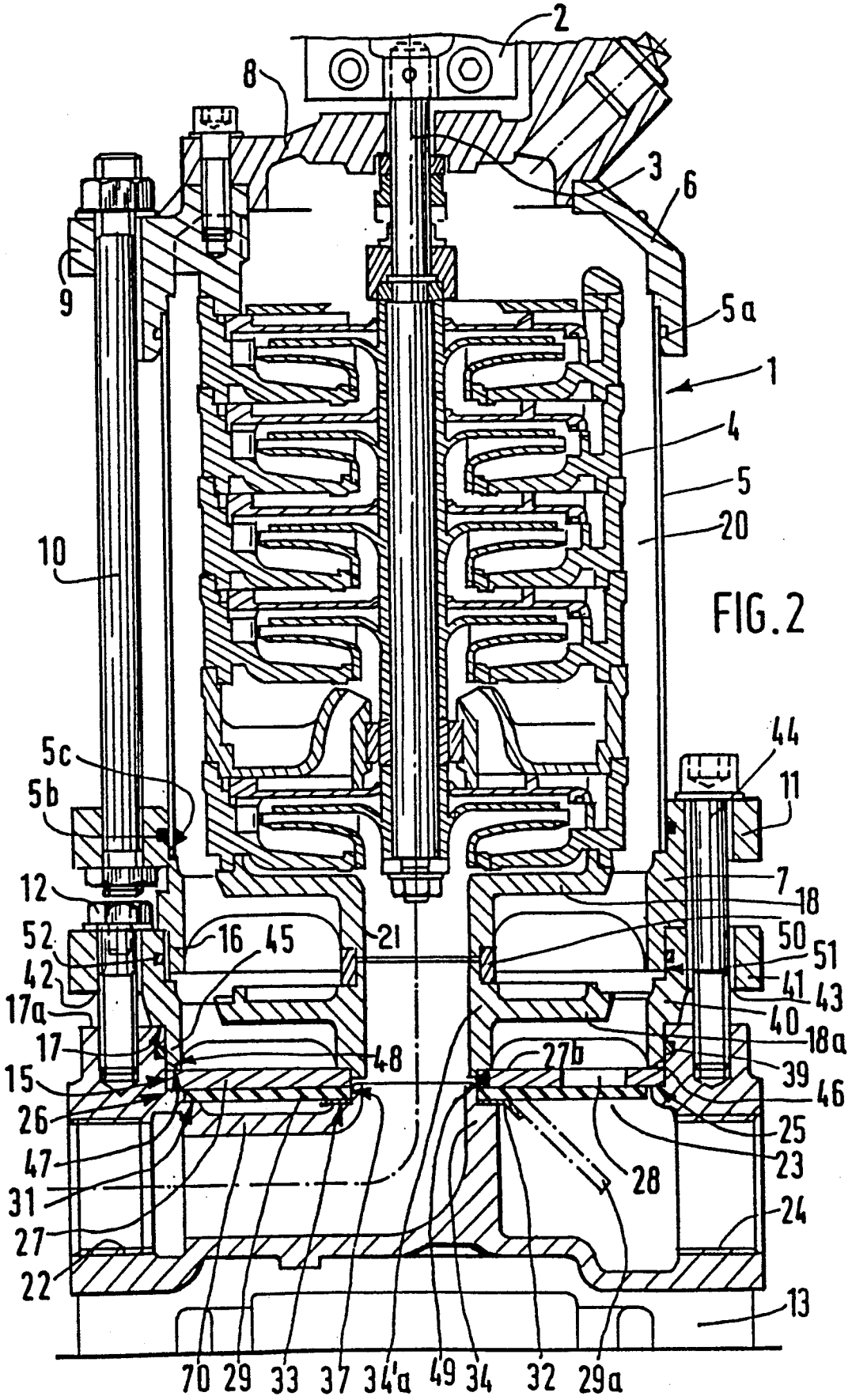
FIG. 2 is a view similar to FIG. 1 illustrating a second embodiment of the invention.

FIGS. 1 and 2 show a vertical replaceable pack multicellular pump 1 of the centrifugal type which is driven in rotation by a motor that is not shown and is secured on top of a supporting flange and linked to the pump rotor by a coupling 2 (which is partially shown in FIG. 2) and a pump shaft 3. The stages of the pump (the case of a pump with five stages is considered here) each consist of a rotor or pump impellor secured onto shaft 3 by keying or other suitable means and of a stator forming a delivery space where the kinetic energy imparted to the fluid is recovered for transformation into pressure, and for transferring the pumped fluid to the next stage.

The complete assembly 4 of the stacked pump stages is inserted, together with its bearings, into a pressure-resistant and corrosion-resistant tube or pump barrel 5 (which for example is in stainless steel) and which is closed off at each end by a respective upper end plate 6 and lower end plate 7. The upper end plate 6 is closed off by a cover 8 which acts as a support for the electric drive motor (not shown) and includes a flanged part 9 carrying an annular ring of holes for bolts o tie rods 10 for clamping the two end plates 6 and 7 together. The lower end plate 7 has an outer flanged portion 11 carrying a series of holes for alternating passage of bolts 10 and of screws 12 for securing the lower end plate 7 onto a pump body 13 which generally takes the form of a casting and is provided with an annular ring of threaded holes 14 arranged around a bore 15 adapted to receive a sleeve 16 of lower end plate 7. It will be seen that the end plates 6 and 7 each include an internal flanged bore for receiving pump barrel 5 in a hermetically-sealed manner, sealing being provided by annular gaskets 5*a* and 5*b* which are each housed in a groove formed in the wall of the flanged bore. A shoulder 17 forms an abutment in the axial direction for the lower end plate 7, said shoulder bearing against a plane upper surface 17*a* formed at the mouth of bore 15 perpendicularly to the threaded holes 14.

The lower end plate 7 includes a central portion 18 provided with peripheral passages 19 formed between radiating members extending to flange portion 11, said passages being linked to an annular chamber 20 provided inside pump barrel 5 between the outlet from the last stage of the pump and the stack 4 of pump stages. The central portion 18 of end plate 7 forms a central inlet connector 21 at its center and this terminates at the threaded inlet opening 22 of pump body 13.

In the embodiment shown in FIG. 1, the discharge from bore 15 is transferred to an opening 23 formed inside pump body 13 and linked to the threaded delivery outlet 24, bore 15 extending down to a first plane annular shoulder 25 that is perpendicular to the bore.

A flat annular non-return valve unit 26 is arranged at the base of bore 15, in abutment with shoulder 25. The non-return or check valve unit 26 opens in the delivery direction of the pump and thus interrupts flow from the peripheral passages 19 to the delivery outlet 24. The valve unit 26 here comprises a fairly rigid flat annular plate 27 which for example is in steel of a thickness of some 5 mm, and which has been machined so as to be perfectly flat on its two faces in order to accurately fit and bear against the flat surface of shoulder 25. The outer cylindrical surface of valve plate 27 can be a sliding fit in bore 15 or, alternatively, can exhibit slight clearance with respect to the bore.

The valve plate 27 has at least one through hole 28, and more generally a series of regularly distributed through holes 28 with their axes for example lying substantially in an area covering the outer two thirds of the width of the plate. The through holes 28 that are close to a transverse partition 70 that isolates them from the inlet can be omitted. The side of valve plate 27 directed towards the delivery outlet 24 is covered by a flat flexible member 29 which is substantially in the shape of a ring adapted to close off the through passages 28. The said flexible ring member 29 advantageously consists of a disc member in an elastomeric material having a thickness of several millimeters for withstanding the effects of the pumping pressure which forces it against the holes 28. The disc member 29 comes to bear on side 30 of valve plate 27 firstly as a result of its peripheral abutment on a shoulder 31 at the inlet opening 22 end and, secondly, at it center region, through the presence of a sheet metal annular member 32 that bears against a second shoulder 33 formed around the outer wall of an inlet connector 34 of pump body 13.

Figure 5:
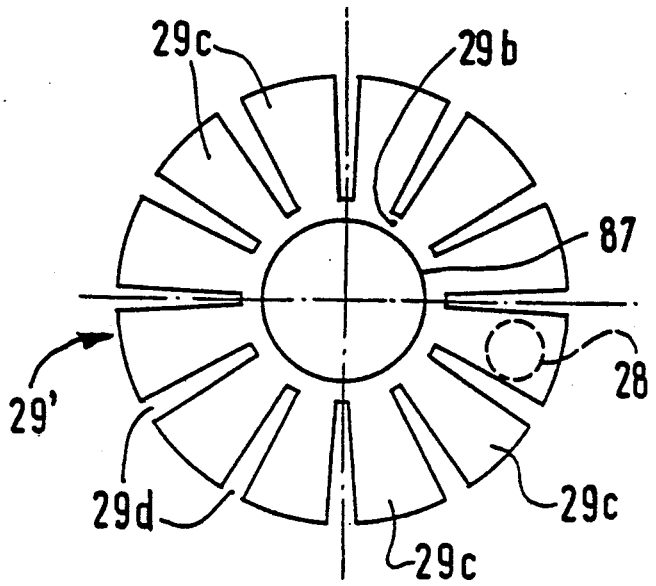
FIG. 5 is a plan view of a metal disc member constituting the actual valve in one alternative embodiment of the non-return valve of the pump assembly according to the invention.

The flexible ring member 29 can also consist of a thin circular plate in a material for example in sheet consisting of a strong resistant metal such a brass or stainless steel. In the embodiment shown in FIG. 5, the thin stainless steel plate 29' is provided with radial slots 29*d* of constant width or with their width increasing towards the outer edge, as shown in FIG. 5. These slots 29*d* which are open at the outside periphery extend inwardly up to a continuous crown region 29*b* surrounding a central passage 87 having a diameter that is slightly greater than the machined outer diameter of connector 34 above shoulder 33. A series of radial blade elements 29*c* are thus constituted which project outwardly from crown portion 29*b* and which each are able to close off a through hole 28 (one single one of such holes 28 is shown in dashed lines on one of the blade members 29*c*) in order to each constitute, together with the flat surface of rigid valve plate 27, a leaf valve able to withstand elevated back-pressures without suffering from wear with the passage of time.

In the embodiment shown in FIG. 1, the rigid valve plate 27 of non-return valve unit 26 is maintained, firstly, in direct abutment against shoulder 25 by a resilient ring or circlip 35 housed in a groove of bore 15 and, secondly, through indirect abutment via resilient elastomeric disc member 29 on the shoulder 33 of central connector 34 by means of a resilient ring or circlip 36 housed in a groove of the machined cylindrical outer surface 37 of the inlet connector 34. Cylindrical surface 37 can also act as a guide for the corresponding central hole of valve plate 27 and of resilient disc member 29. In order to ensure that a substantially sealed connection is set up between the central inlet connector 21 of central portion 18 of the lower end plate 7 and, respectively, the central connector 34 of pump body 13, these connectors are fitted with respective mating sleeves 21*a* and 34*a* between which a sealing ring gasket 38 is fitted.

Good sealing between rigid plate 27 and shoulder 33 can be obtained through direct contact or by fitting an annular seal between the periphery of plate 27 and the annular surface of shoulder 33, thus ensuring permanent sealing even under elevated pressures and/or temperatures at the delivery side of the pump.

In accordance with one advantageous embodiment directed to the manner of mounting the non-return valve plate and the mechanical strength of the latter under pressure, sleeves 16 and 21*a* are extended to come into abutment against the upper surface 27*b* of rigid plate 27 when the screws 12 are tightened. In this embodiment, shoulder 17 is slightly set back in order not to bear against the upper flat side 17*a*, and the extensions of sleeves 16 and 21*a* are adapted to as to leave a gap surrounding the respective resilient sealing rings 35 and 36 thus avoiding the latter coming into contact with the extensions. The end portions of said extensions are flat to ensure they bear correctly against the upper surface 27*b*. When lower end plate 7 is removed, the rigid plate 27 of the non-return valve unit is now only retained by the resilient sealing rings 35 and 36 which are in fact only able to withstand low delivery pressures, but this is of no consequence since the actual delivery pressure is then non-existent or very low. When end plate 7 is in place, the extensions of sleeves 16 and 21*a* provide considerable annular retention surfaces which, together with plate 27, are able to withstand appreciable delivery pressures (which can reach several tens of bars in environments that can on occasions exceed a temperature of 200° C.) prevailing at the delivery outlet 24.

The operation of the pump assembly illustrated in FIG. 1 will now be explained. When the pump is mounted in the position illustrated in FIG. 1, the sleeve 16 of lower end plate 7 is sealingly engaged into the bore 15 and in contact with a ring gasket 39, tightening the ring of screws 12 now keeping the bottom end plate 7 firmly in position on pump body 13 while the bolts 10, which constitute tie-rods, ensure the replaceable pack 1 is firmly clamped in place. The pressure of the fluid that is forced by the pump into the annular chamber 20 pushes the resilient disc member 29 back in the direction of delivery to cause it to adopt the open position 29*a* shown in dash-dot lines in FIGS. 1 to 3.

Should the pump stop for any reason, including technical failure, because of the prevailing delivery pressure, maintained for example through a link to a pressurized compensating tank, the resilient disc member 29 constituting the movable part of the valve unit is immediately caused to come into contact with rigid plate 27 and close off the holes 28. If it is required to exchange the replaceable cartridge or pack 1, it is sufficient to loosen the screws 12 after removing the pump drive motor, in order to extract sleeve 16 from the bore 15. The inlet opening 22, now that it is no longer under pressure, only gives rise to a tiny amount of liquid leaking out, which stops immediately. The non-return valve unit 26 retains its position, held by the resilient rings or circlips 35 and 36, against the pressure prevailing at the delivery side. In order to ensure there will be no leakage in this position, a ring sealing gasket 27*a* can be provided between a chamfered part of the outer contour of the annular plate 27 and the surface where shoulder 25 and bore 15 meet. Compression of the elastomeric material of disc member 29 between plate 27 and disc member 32 ensures, on the other hand, a certain degree of sealing in the region of shoulder 33 of connector 34. The seal provided by the non-return valve unit 26 is not intended to last for several days but rather is designed to last during the several hours that allow ample time for pack 1 to be removed and replaced by a replacement unit which is fitted by engaging sleeve 16 into bore 15, followed by tightening of the screws 12 in order to firmly secure the complete hydraulic pack 1 on pump body 13. When the pump inlet is under pressure (pressures of up to 15 bar sometimes obtaining in some water pressure boosting installations), a shut-off valve must be provided for isolating the inlet end before replacing pack 1 with the pumps closed down.

The use of concentric resilient rings or circlips according to the solution shown in FIG. 1 is, as a trade-off for the highly compact arrangement obtained, not always the best solution in certain cases. Firstly, in the case of high power pumps, the very high pumping forces produced are no longer able to be withstood by the resilient rings or circlips while the axial retention of such circlips is frequently inadequate and cannot be adjusted or corrected. Secondly, after long service life in corrosive environments, it is frequently impossible to remove such resilient rings from their annular groove, rendering it impossible to take out the non-return valve unit if this is necessary.

In order to overcome these disadvantages, the present invention provides the solution shown in FIG. 2 which is not as compact but is stronger and easier to adjust while providing a more flexible arrangement that is more readily adaptable to existing pump bodies. The parts shown in FIG. 2 that are identical or similar to those shown in FIG. 1 carry the same reference numerals.

In order to retain the non-return valve unit 26 of the centrifugal pump assembly shown in FIG. 2 in position, a retaining insert plate 40 that is similar or identical to the lower end plate 7 for pack 1 is used and this is fixed onto pump body 13 using a ring of screws 12 passing through passages 42 in a flanged portion 41. The passages 42 alternate on flanged portion 41 with passages 43 through which longer fastening screws 44 pass for securing the flanged portion 11 of the end plate 7 for replaceable pack 1. The retaining insert plate 40 which acts as a retaining plate for the non-return valve unit 26 is provided with an end sleeve 45 which engages in a sealed manner into bore 15 by the provision of a ring sealing gasket 39. Sleeve 45 also comes into abutment, via a first annular supporting surface defined by a forward peripheral crown portion 47, against a plane peripheral annular region of valve plate 27, a ring sealing gasket 46 being fitted between a chamfer 48 of forward crown portion 47 and, simultaneously, bore 15 and the upper peripheral forward face of plate 27.

The central portion 18*a* of retaining insert plate 40, which is similar or identical to the portion 18 of lower end plate 7, abuts, via a second annular supporting or abutment surface 49 formed on a central inlet connector 34*a*, against the inner periphery of valve plate 27 in order to sealingly urge it against the elastomeric material disc member 29 that bears on shoulder 33 of the central connector 34 of pump body 13. In order to complete the inlet path of the pump, the inlet connector 21 of the central portion 18 of lower end plate 7 of the replaceable pack 1 bears in a sealed manner against the inlet connector 34*a* of retaining insert plate 40, in the same manner as the sealed abutment relation between connectors 21 and 34 of FIG. 1 or, as illustrated in FIG. 2, via an elastomeric material sleeve 50 which is adapted to compensate the largest possible axial clearances. Insert plate 40 includes a bore 51 having a ring gasket 52 for receiving sleeve 16 of the lower end plate 7 of the replaceable pack 1. It can be seen that if bore 5*c* for receiving pump barrel 5 is adapted to enable fitting of not only the outer surface of pump barrel 5 but also the outer surface of sleeve 16, it is possible to employ end and insert plates 7 and 40 that are identical for the embodiment shown in FIG. 2, which constitutes a considerable advantage in series production when manufacturing the parts of the pump assembly.

Operation of the pump assembly shown in FIG. 2 can be readily deduced from the explanation provided for the pump in FIG. 1. With the pump mounted, as illustrated in FIG. 2 and on line, the replaceable pack 1 of rotors and stators can be removed by unscrewing the screws 44. The screws 12 that are inserted between screws 44 keep the retaining insert plate 40 in position, and this insert plate, which is able to withstand significant pressures in view of its thickness and the provision of ribs thereon, counteracts any displacement, brought about by the delivery pressure, of valve plate 27 of the non-return valve unit 26. If it becomes necessary to replace the non-return valve, for example because it is no longer sealing properly, it is always possible to remove the retaining insert plate 40 after unscrewing the screws 12 and gaining access to the non-return valve unit 26 which now is in no danger of being stuck as a result of corrosion, as in the solution in FIG. 1.

It is obviously possible to provide for non-return valve unit 26 of the pump to be kept directly in position by abutment of lower end plate 7 against rigid plate 27. In such an embodiment, the overall height of the pump is reduced but, in order to remove replaceable pack 1, it becomes necessary to previously isolate non-return valve unit 26 from the delivery pressure since the valve is no longer held in position after pack 1 is removed. Such isolation can be obtained using well know means such as a non-return valve fitted downstream of delivery outlet 24, or through the use of a shut-off cock.

Figure 3:
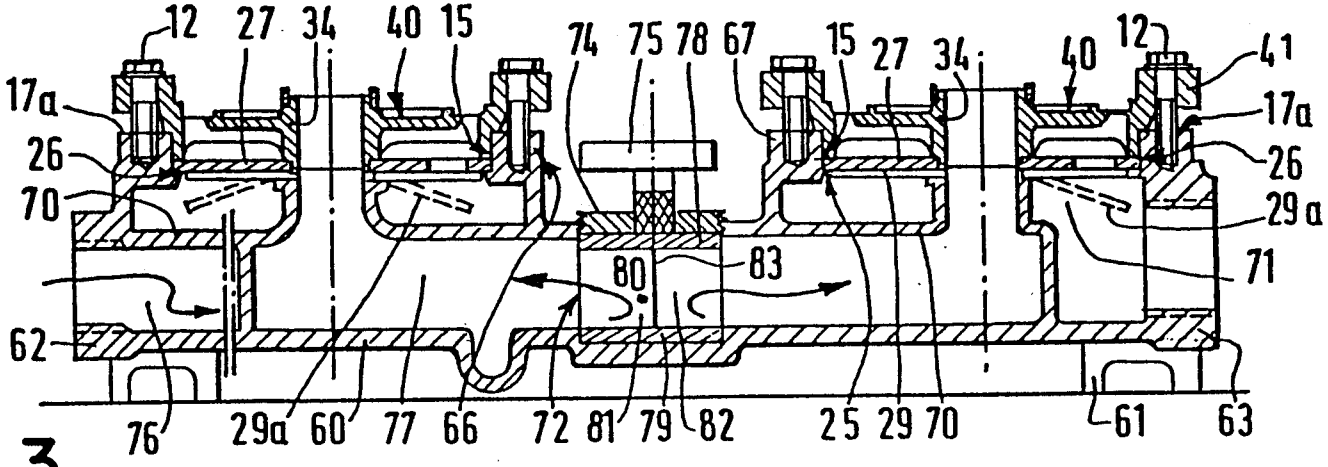
FIG. 3 is a cross-section taken along line III—III of FIG. 4 of a housing block for a twin-pump unit according to the invention.
Figure 4:
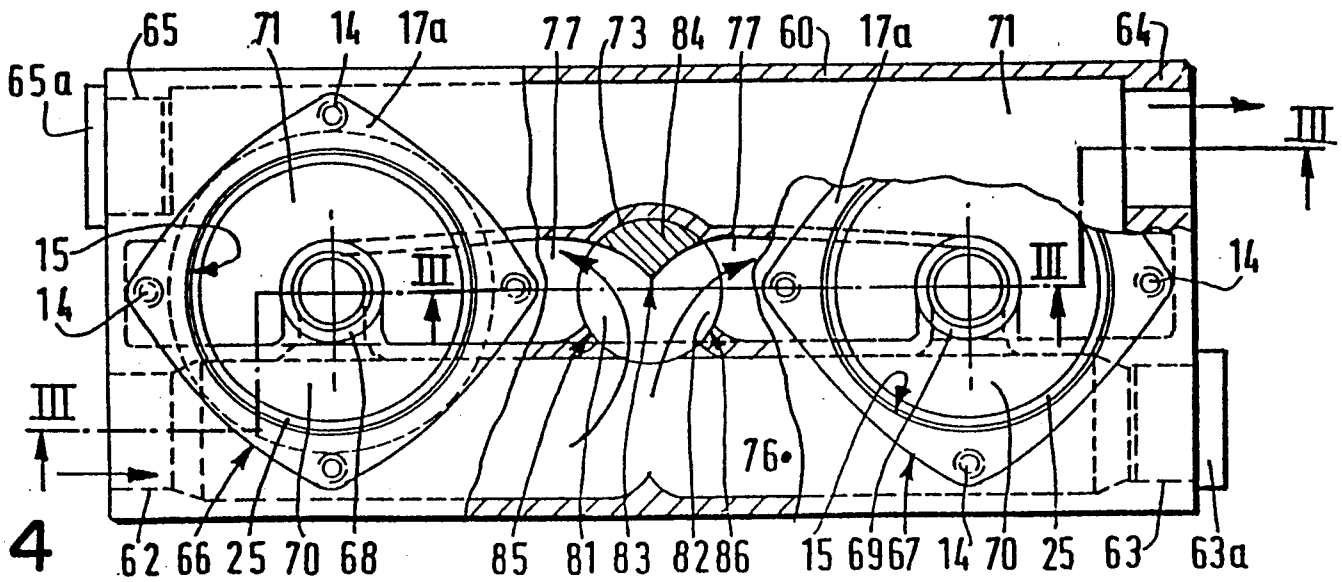
FIG. 4 is a plan view of the housing block shown in FIG. 3 with the non-return valve having been removed and the arrangements for inlet via an inlet changeover cock and for outlet which are normally hidden by the top part of the housing block being shown in cross section.

The block incorporating two pumps shown in FIGS. 3 and 4 consists of a cast casing 60 with a base plate 61 and two inlets 62 and 63 and two fluid outlets 64 and 65, inlet or outlets that are not used being closed off by threaded plug 63*a* and 65*a*. Two flat carrier members 66 and 67 for securing a pump pack project upwardly and surround respective central fluid inlet connectors 68 and 69. The carrier members 66 and 67 are provided with threaded holes 14 on their upper flat side 17*a* for receiving screws such as screws 12 or 44 shown in FIGS. 1, 2 and in FIG. 3. A receiving bore 15 similar to the one shown in FIGS. 1 and 2 is provided inside the carrier members, the said bore 15 terminating at its periphery on a flat shoulder 25 for receiving valve plate 27 and, on the other side of a dividing partition 70 (also shown in FIGS. 1 and 2), at a passage 71 leading to the pump outlet. In FIG. 3, each one of bores 15 is shown fitted at its bottom end region with a non-return valve unit 26 kept in position by a retaining insert plate 40 fixed by screws 12 onto the flat carrier member 66 or 67. Each one of the insert plates 40, which are of the same type as the one shown in FIG. 2, is ready to receive a replaceable pack 1 of stators and rotors.

It can be clearly seen in the torn away portion that a control shutter valve or cock 72 for dividing the inlet to the pump is mounted in a passage 73 that opens to the outside of the pump and is closed by a sleeve 74 to allow an operating handle 75 to extend externally of the pump in a sealed manner. The control cock 72 is mounted in the connection between an inlet chamber 76 inside housing 60 and inlet distributing channel 77 leading to inlet connectors 68 and 69. The active part of control cock 72 includes two cylindrical end portions 78 and 79 which provide guiding in passage 73, and a central hollowed-out portion 80 providing two passages 81 and 82 to each one of the inlet connectors 68 and 69. The solid flared portion 84 with a central vertical vertex 83 of hollowed-out central portion 80 is able, by bearing against cooperating surface 85, to close off the passage to connector 68 and, by bearing against cooperating surface 86, to close off the passage to connector 69. When it simultaneously bears against cooperating surfaces 85 and 86, the solid portion 84 simultaneously closes off the inlet to the two inlet connectors 68 and 69.

When the twin-pump unit 60 is only running on one pump, for example the pump fixed to carrier member 66, and this pump becomes defective, the other pump can be started up manually or automatically without pumping back to the other faulty pump occurring, thanks to the provision of non-return valve unit 26. If it is desired to replace the replaceable hydraulic pack 1 of the faulty pump, it is sufficient to rotate control cock 72 by means of operating handle 75 in order to bring the solid portion 84 to a position where it closes off the passage to inlet connector 68. After removing the removable pack, the non-return valve unit 26 fitted in the base of bore 15 of carrier member 66 prevents any flow of fluid originating from the pumping pressure of the other pump which is now operating, and it is possible to fit a new hydraulic pack without any leakage of fluid occurring.

After refitting a hydraulic pack 1 and its drive motor, the pump can be put into operation again to deliver fluid through non-return valve unit 26. If the pump unit uses twin pumps in parallel, and one of the pumps failed, operation with one pump running is possible allowing the failed pump to be removed without leakage occurring, the faulty pump being replaced by a properly working pump which will then be put into operation to resume twin pump operation. The manner of arranging the non-return valve according to the invention makes it possible, in every case, to provide a pumping unit that is more compact, more reliable, easier to service and hence more economical.

Figure 6:
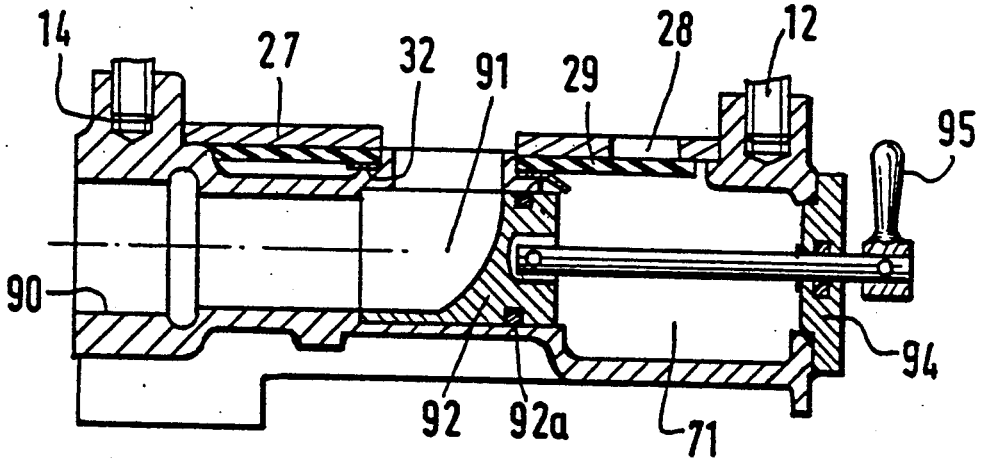
FIG. 6 is a cross-sectional view of a housing block for several vertical pumps according to the invention.

Proceeding in the same manner, it is possible to provide multiple blocks employing more than two vertical pumps arranged in parallel. In FIG. 6, an arrangement for a multiple pump block is illustrated in a cross-sectional view at right angles to one of the pumps. FIG. 6 is a view similar to the right-hand end of FIG. 3, that is, a view taken along the center of the structure. An inlet connector 90 joined to the common suction end joins up with a suction inlet 91 formed in a changeover block 92 able to rotate in a passage in a sealed manner through the provision of at least one annular seal 92*a* and linked, via a rod passing in a sealed manner through a cover 94, to an external changeover lever 95. By rotating the block 92 using operating lever 95, it becomes possible to isolate the inlet 91 to any pump that is not working correctly or needs servicing or repair. The non-return valve of each pump, mounted in accordance with the invention employing the rigid plate 27 and annular washer 29, isolates the common delivery chamber 71, through which the rod of lever 95 passes, from the circuit of the pump that is shut down or on which repair or replacement work is taking place. Rotating block 92 performs the function of a two-way tap: inlet open or closed, which is independently controlled for each pump by an external lever 95 or by any suitable equivalent means which, if needed can be remotely controlled.

The invention is obviously not limited to the embodiments that have been described and illustrated but may undergo numerous variations accessible to those skilled in the art without this however leading to a departure from the scope of the invention.

What is claimed is:

1. A vertical centrifugal hydraulic pump assembly comprising:

a) a plurality of hydraulic interstage pumping assemblies enclosed in at least one replaceable cartridge constituting a block clamped vertically between two flanged end plates with a sleeve portion engaging therewith;

b) a pump body having:

(i) a receiving bore with a base, center and internal wall defining an outer edge and into which said cartridge is secured by one of said flanged end plates, and (ii) a central inlet connector with an outer wall;

c) said cartridge respectively being connected at the center of said bore to the central inlet connector for said pump assembly and at the outer edge of said bore to a pump delivery outlet;

d) a flat annular non-return check valve unit opening in a delivery sense of said pump assembly, said non-return valve unit being arranged at the base of said receiving bore between the internal wall of said bore and the outer wall of said central inlet connector;

e) a first shoulder at the base of said receiving bore;

f) a second shoulder on the outer wall of said central inlet connector; and g) retaining means for retaining said flat non-return valve unit in axial position at the base of said receiving bore to keep said non-return valve unit in operation against a prevailing delivery pressure of said pump assembly after removal of said cartridge containing said hydraulic interstage pumping assemblies.

2. Pump assembly according to claim 1 wherein:

a) said non-return valve unit consists of:

(i) a rigid flat annular plate, incorporating at least one through hole, and having an outer cylindrical contour fitting substantially into said receiving bore and a periphery of one flat face thereof supported against said first shoulder provided at the base of said receiving bore, and (ii) a flat flexible annular member applied against said annular plate at a side thereof opposing said removable cartridge and internally of said pump body; and b) a respective first resilient annular element housed in a groove formed in the internal wall of said receiving bore and a second resilient annular element housed in a groove formed in the outer wall of said central inlet connector for retaining said flat annular plate in abutment against said first and second shoulder.

3. Pump assembly according to claim 1 wherein:

a. said non-return valve unite consists of:

(i) a rigid flat annular plate, incorporating at least one through hole, and having an outer cylindrical contour fitting substantially into said receiving bore and a periphery of one flat face thereof supported against said first shoulder provided at the base of said receiving bore, and (ii) a flat flexible annular member applied against said annular plate at a side thereof opposing said removable cartridge and internally of said pump body;

b. a retaining end plate having:

(i) an outer end sleeve, (ii) a central inlet connector, (iii) a first annular supporting surface on said end sleeve, (iv) a second annular supporting surface on the central inlet connector, and (v) a receiving bore on said end sleeve for said sleeve portion of said replaceable cartridge; and c. said retaining end plate is substantially similar to the one end plate for said removable cartridge; and d. said flat annular plate is maintained in abutment against said first and said second shoulders by abutment of an outer peripheral region of a flat surface thereof spaced from each through hole against said first annular supporting surface on the end sleeve of said retaining end plate and by abutment of an inner peripheral region of said flat surface thereof against said second annular supporting surface on the central inlet connector of said end plate.

4. A pump assembly according claim 1 further comprising:

a) a pumping unit having a common inlet and outlet housing block;

b) at least two of said vertical centrifugal pump assemblies, each fitted with said replaceable cartridge; and c) means for mounting each of said pump assemblies on said housing block for selective individual and simultaneous operation.

5. A pumping assembly according to claim 4, wherein said common housing block includes an integrated pump inlet changeover cock having four positions respectively corresponding to isolation of both pump assemblies from said common inlet, the connection of the two pump assemblies to said common inlet, and two positions in which either one of said pump assemblies is connected to said common inlet while the other pump assembly is isolated therefrom whereby, after isolating one of said pump assemblies while the other pump assembly remains connected to said common inlet, said replaceable cartridge of the isolated pump assembly can be dismounted while being isolated from said prevailing delivery pressure by said non-return valve.

6. A pumping assembly according to claim 4, wherein said common housing block includes, for each vertical centrifugal pump assembly, a two position cock, with two positions corresponding respectively to opening and closing the pump assembly from communication with said common inlet, each of said cocks being independently controllable for each pump assembly, and each of said pump assemblies being provided with said flat non-return valve unit adapted to isolate it from said prevailing delivery pressure.

* * * * *